United States Patent [19]

Kiriake

[11] Patent Number: 4,875,572

[45] Date of Patent: Oct. 24, 1989

[54] TRAY TRANSFER DEVICE

[75] Inventor: Masaharu Kiriake, Uji, Japan

[73] Assignee: Murata Kikai Kabushiki Kaisha, Kyoto, Japan

[21] Appl. No.: 97,449

[22] Filed: Sep. 16, 1987

[30] Foreign Application Priority Data

Sep. 20, 1986 [JP] Japan ..... 61-222544

[51] Int. Cl.[4] ..... B65G 25/08

[52] U.S. Cl. ..... 198/744; 198/747; 198/774; 57/274; 57/276; 242/35.5 A

[58] Field of Search ..... 198/741, 742, 743, 744, 198/745, 746, 747, 749, 774; 57/274, 276; 242/35.5 A

[56] References Cited

U.S. PATENT DOCUMENTS

| | | | |
|---|---|---|---|
| 2,523,968 | 9/1950 | Paulson,Sr. | 198/774 |
| 2,583,968 | 1/1952 | Rosseau | 198/774 X |
| 3,048,258 | 8/1962 | Skold | 198/772 X |
| 3,439,821 | 4/1969 | Hand | 198/774 X |
| 4,282,970 | 8/1981 | Smock | 198/772 |
| 4,484,676 | 11/1984 | Plumridge et al. | 198/774 X |
| 4,603,770 | 8/1986 | Hartness | 198/745 X |
| 4,616,789 | 10/1986 | Matsui et al. | 242/35.5 A X |

*Primary Examiner*—Robert J. Spar
*Assistant Examiner*—Lyle K. Kimms
*Attorney, Agent, or Firm*—Spensley Horn Jubas & Lubitz

[57] ABSTRACT

A tray transfer device in which a tray carrying a bobbin is fed along a tray feeding path. The tray transfer device comprises a sliding member which slides along the tray feeding path reciprocally and engaging members which are located on the sliding member by a pitch equal to the predetermined pitch such that the trays may be pitch fed at a time by the engaging members.

19 Claims, 3 Drawing Sheets

TRAY TRANSFER DEVICE

FIELD OF THE INVENTION

This invention relates to a transfer device for trays for feeding bobbins.

DESCRIPTION OF THE RELATED ART

Some of ring spinning frames employ, as a device for exchanging a spinning bobbin wound on a spinning spindle for an empty bobbin, a device of the type wherein empty bobbins are mounted on pegs secured to a transport band running along the spindles in a pitch equal to the pitch of spinning spindles or equal to one half of the spinning spindle pitch and are thus arranged in a row at positions corresponding to the individual spindles so that spinning bobbins may be exchanged for empty bobbins by an automatic doffing apparatus. In a ring spinning frame of such a type as described just above, the transport band only circulates along a spinning frame within an area of the spinning frame, and accordingly, in order to supply bobbins to a winder of a next step, it is necessary to provide a station which draws spinning bobbins off the transport band and supplies them to the winder.

Meanwhile, as different from the method described above, there is a ring spinning frame of a type wherein spinning bobbins and empty bobbins are transported directly from a spinning frame to a winder or from a winder to a spinning frame by means of bobbin transporting trays which are transported mutually between the spinning frame and the winder.

Trays which are employed for such a ring spinning frame of the latter type as described above include a peg erected uprightly on a base member in the form of a disk and have a diameter equal to the spindle pitch so that, as they are fed with bobbins mounted on the pegs thereof, the trays and the empty bobbins thereon may be arranged in a row along the spindles of the spinning frame while they remain in an integral relationship with each other and they may be positioned through contacting relationship between adjacent trays.

Accordingly, in the system described above, only if trays are placed on a conveyor and fed thereby until the first tray is stopped at a position corresponding to a spindle of an end portion of the spinning frame, then the following trays can be contacted with each other until they are arranged in a row corresponding to the individual spindles.

However, the trays described above are used exclusively for spinning frames in which they can be used, and it is impossible to use the trays for any other spinning frame which has a different spindle pitch. In a recent production system for production of a large number of kinds of articles in small masses, it is desired that same trays can be used for different spinning frames.

OBJECT AND SUMMARY OF THE INVENTION

It is an object of the present invention to provide a tray transfer device whereby trays of different types can be arranged in a row and fed in a spaced relationship by a distance equal to the spindle pitch.

An embodiment of the present invention provides a tray transfer device wherein a sliding member is provided which slides along a feeding path for trays by a distance equal to a predetermined pitch, and tray engaging members are located on said sliding member by a pitch equal to the predetermined pitch such that the trays may be pitch fed at a time by said engaging members.

DETAILED DESCRIPTION OF THE INVENTION

Now, an embodiment of the present invention will be described with reference to the drawings.

Figure 2:
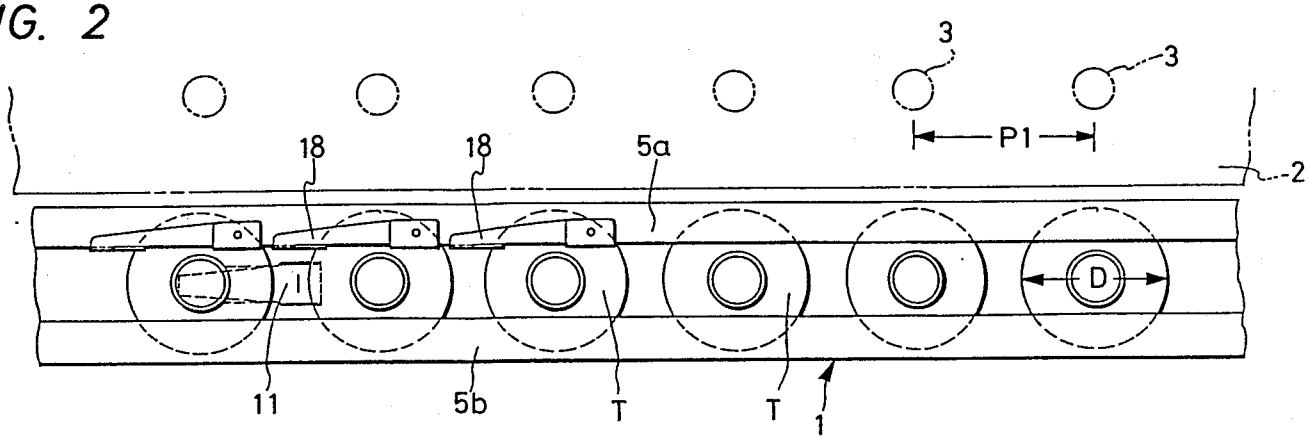
Figure 1:
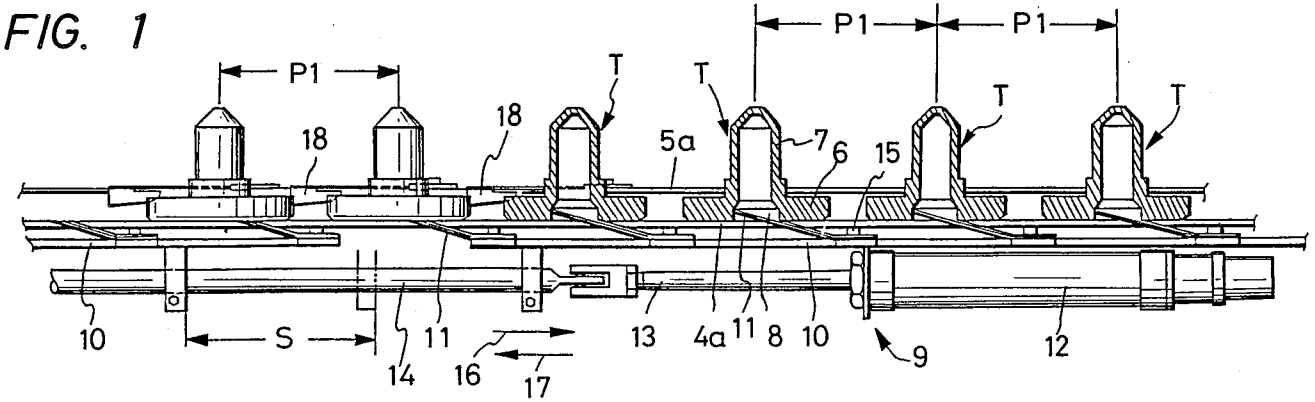
FIG. 1 is a sectional front elevational view showing an embodiment of device of the present invention, FIG. 2 a plan view of the device of FIG. 1, FIG. 3 a sectional side elevational view of the device of FIG. 1, FIG. 4 a partial enlarged plan view of the device of FIG. 1, FIG. 5 a partial enlarged front elevational view of the arrangement of FIG. 4, FIG. 6 a schematic illustration showing trays and a spindle pitch as well as a driving relationship of engaging members, and FIG. 7 a front elevational view of general construction showing another embodiment of the present invention.
Figure 3:
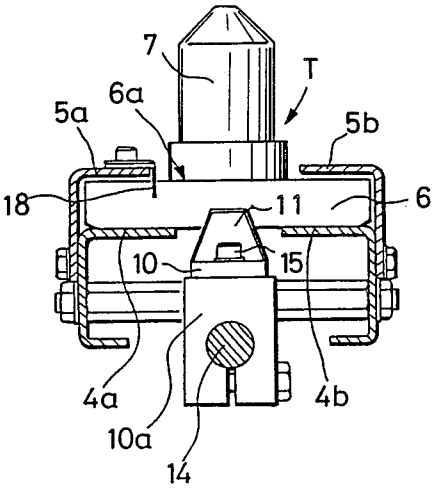

Referring to FIGS. 1 to 3, reference numeral 1 denotes a bobbin tray feeding path which extends, for example, along spindles 3 of a spinning frame 2. The bobbin tray feeding path 1 is composed of a pair of tray receiving plates *4a*, *4b* defining a cut away portion therebetween, and a pair of guide plates *5a*, *5b* for controlling the feeding direction of trays on the tray receiving plates *4a*, *4b*.

The trays T include a base member 6 in the form of, for example, a disk, and a peg 7 formed on the base member 6 for receiving a bobbin thereon. Each of the trays T has a concave engaging portion 8 formed in a lower face thereof and adapted for a tray feeding device described below.

A tray feeding device 9 is composed of sliding bars 10, 10 each formed of one or a plurality of divided parts and located along the spindles of the spinning frame 2, and engaging members 11 located in an equal pitch with the spindles on the sliding bars 10, 10. The sliding bars 10, 10 are securely supported on a reciprocal rod 14 connected to a piston rod 13 of a hydraulic cylinder 12. In particular, each of the engaging members 11 is composed of one or a plurality of leaf springs which has or have one end or ends thereof secured to the corresponding bar 10 by means of a screw 15 and the other ends thereof positioned adjacent the engaging portion 8 of a tray. The pitch between ends of the engaging members 11 is equal to the pitch P1 of the spindles.

Accordingly, if the piston rod 13 is moved a fixed stroke S in a direction of an arrow mark 16 in FIG. 1, then each of the leaf springs 11 is a little deformed in the counterclockwise direction around a fulcrum of the fixed position 15 by a lower face of a tray T and thus passes below the lower face of the tray T until it comes to a position below the lower face of another tray located rightwardly of the former tray by a distance equal to one pitch with the end thereof positioned in the engaging portion 8 of the latter tray. Subsequently, as the piston rod 13 is moved by the stroke S in a direction of an arrow mark 17, all the trays which engage with the engaging members 11 are fed at a time by a distance equal to one pitch P1 in a direction of the arrow mark 16. It is to be noted that the stroke S of the piston rod 13 by the hydraulic cylinder 12 is a little greater than the spindle pitch P1 so that when the engaging members are returned to their initial positions, they may be located assuredly in the engaging portions 8 on the lower faces of the trays.

Figure 4:
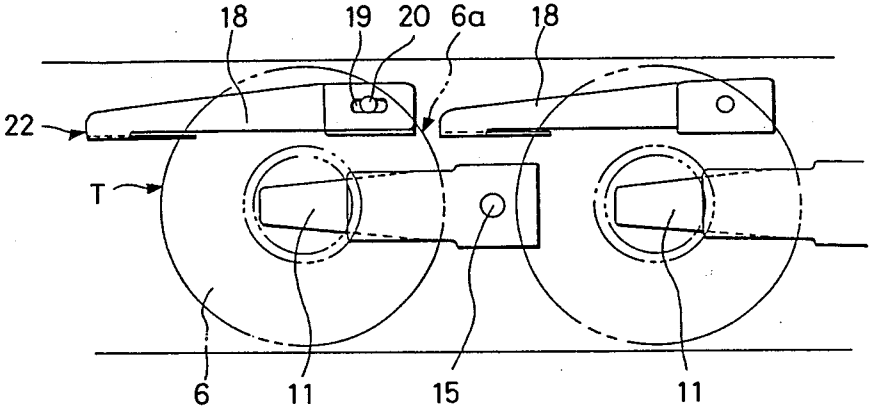
Figure 5:
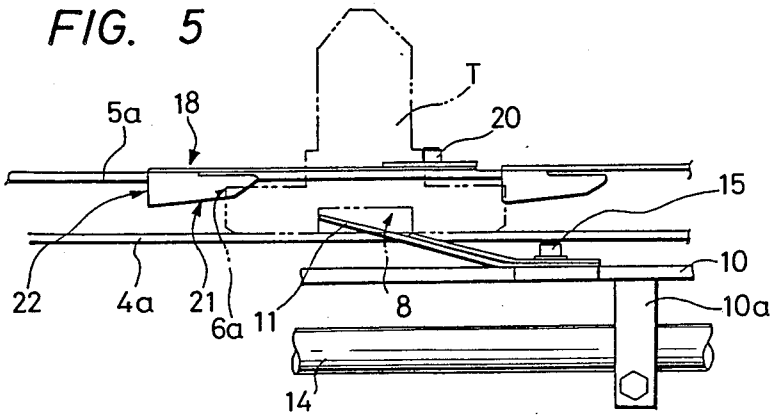

It is to be noted that adjacent trays do not contact with each other in the embodiment described above. Accordingly, if a tray is only pushed by an engaging member 11, there is the possibility that it may overrun without stopping at a predetermined position due to its own inertia or that it may turn back when a leaf spring is deformed and pass below the lower face of the tray upon returning of an engaging member 11. Accordingly, in the embodiment described above, a positioning plate 18 for preventing overrunning and turning back of a tray is securely located at each of positions adjacent the spindles. In particular, referring to FIGS. 4 and 5, the positioning plate 18 is secured for adjustment in a tray feeding direction on one 5*a* of guide plates 5*a*, 5*b* of the feeding path by means of an elongated hole 19 and a screw 20. The positioning plate 18 is formed by bending a single plate and has a contacting portion 21 for contacting with part of the base of a tray T, and a turning back preventing stopper 22 for preventing turning back of a preceding tray. The contacting portion 21 is an inclined edge which is inclined in a direction opposite to the tray feeding direction and is contacted and pushed by an upper circumferential edge 6*a* of the base member 6 of a tray T thereby to prevent overrunning of the tray. Meanwhile, when a tray T of FIG. 5 is fed by a distance equal to one pitch in a leftward direction by the engaging member 11, the plate 18 is pushed by the tray and is thus displaced in the clockwise direction around a fulcrum of the fixed position 20 whereafter it is returned to its initial position after the tray has passed thereby. Thus, the plate 18 is composed of a leaf spring member having an urging force.

Figure 6:
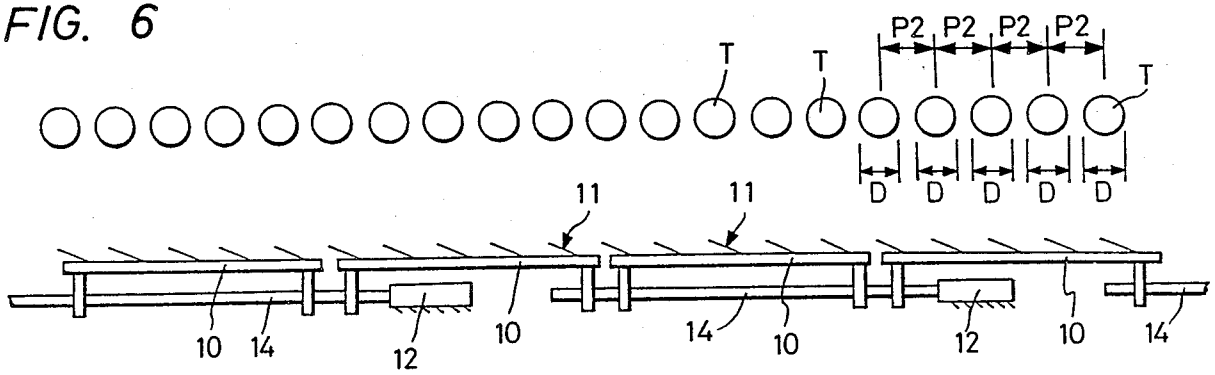

The sliding bars 10 are divided into a plurality of parts as shown in FIG. 6 in order to reduce the cumulative error of the mounted positions of the engaging members, and each of the sliding bars 10 is secured to and moved in an integral relationship with a plurality of rods 14. It is to be noted that because the number of the spindles of the spinning frame reaches up to several hundreds and accordingly a great driving force is required for simultaneous feeding of trays, a plurality of hydraulic cylinders are used, but it is possible to provide a single cylinder having a high power at an end portion of the spinning frame. Further, it is also possible to employ a motor as a driving source for a reciprocal motion of the sliding bars 10 and employ a transmission mechanism involving a rack and a pinion.

While FIGS. 1 and 2 illustrate an example wherein trays T are fed in a spaced relationship by a distance equal to the pitch P1, FIG. 6 illustrates another example wherein the same trays T are arranged in a row in accordance with another spindle pitch P2. In this instance, the pitch of the mounted positions of the engaging members 10 on the sliding bars 10 is also equal to the spindle pitch P2, and naturally it is necessary to adjust the positions of the tray position plates 18 of FIG. 2 in accordance with the spindle pitch. However, if the spindle pitches P1, P2 of the spinning spindles are greater than the diameter D of the trays, the trays T can be applied to any of the spinning frames.

Further, it is possible to employ, in a single spinning frame, various trays of different sizes as lot changing is to be effected. In this case, only if the engaging portions of the various trays do not vary in size but have a fixed size, there is no necessity of adjustment of the positions of the engaging members.

Figure 7:
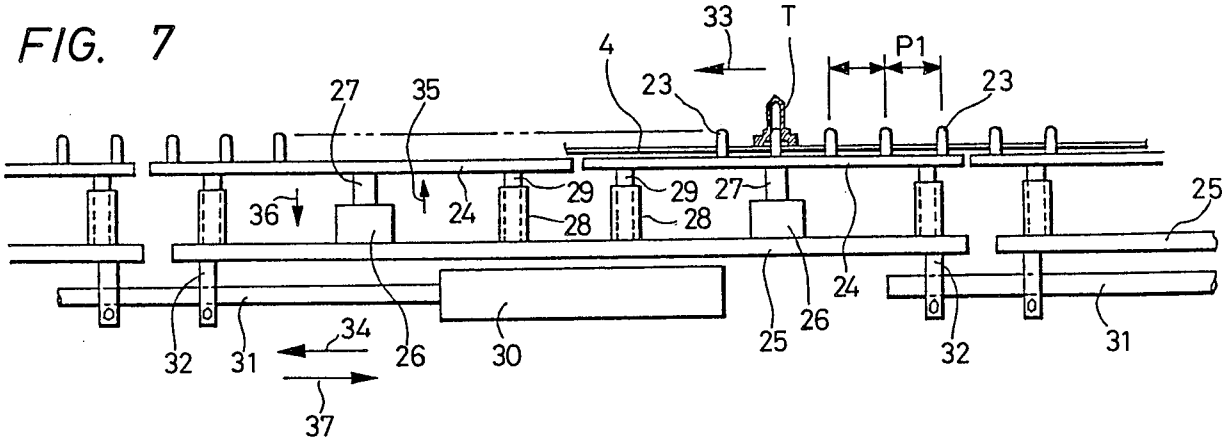

Another embodiment of the present invention is shown in FIG. 7.

In particular, engaging pieces 23 are secured to each of liftable frames 24 in a spaced relationship by a distance equal to a pitch P1 of spinning spindles. Each of the frames 24 is in turn secured to a piston rod 27 of a vertical cylinder 26 on a sliding frame 25. Reference numerals 28, 28 denote guide tubes secured to the frame 25, and the guide tubes 28, 28 guide rods 29, 29 on a lower face of the liftable frame 24. The sliding frame 25 is secured to a piston rod 31 of a horizontal cylinder 30 by way of a leg 32. In particular, when a tray T on the feeding face 4 is to be fed by one pitch in a direction of an arrow mark 33, at first the piston rod 27 of the cylinder 26 is lifted 35 to advance an engaging piece 23 in a position retracted below the feeding path into the engaging portion of the tray T, and then the cylinder 20 is rendered operative so that the piston rod 31 is advanced by a fixed stroke, that is, by a distance equal to the pitch P1 in a direction of an arrow mark 34 to move the members on the sliding frame 25 by a fixed pitch at a time in the direction of the arrow mark 33 to feed the tray by a distance equal to the pitch P1. Then, the piston rod 31 is moved down 36 so that the engaging pieces 23 is moved away from the tray T and retracted below the feeding face whereafter the sliding frame 25 is moved by a distance equal to the fixed pitch P1 in a direction of an arrow mark 37 back to its initial position by the cylinder 30. In this manner, trays on the feeding face 4 are fed at a time in a spaced relationship by a distance equal to the pitch P1.

As apparent from the foregoing description, according to the present invention, an engaging piece for engaging with a tray is located at each of locations spaced by a distance equal to the spindle pitch, and by reciprocating the engaging pieces, trays of even different types can be arranged in a row and fed in a spaced relationship by a distance equal to the spindle pitch. Besides, trays of a single type can be used for another spinning frame which has a different spindle pitch. Thus, a tray feeding device of the present invention is effective particularly in a production system for production of a large number of kinds of articles in small lots.

What is claimed is:

1. A tray transfer device, comprising a sliding member provided along a feeding path for trays and is mounted for reciprocal movement by a distance equal to a predetermined pitch in the tray feeding direction, tray engaging members located on said sliding member by a pitch substantially equal to the predetermined pitch such that the trays may be pitch fed at a time by said engaging members, and tray abutting members spaced apart by a pitch substantially equal to the predetermined pitch and arranged to abut trays in the feeding path, each of said tray abutting members having a first abutting portion arranged to abut a tray and hinder movement of the tray in a first direction, each of said tray abutting members having a second abutting portion arranged to abut a tray and hinder movement of the tray in a second direction opposite to the first direction, wherein trays fed by said sliding member and tray engaging members are maintained at a pitch substantially equal to the predetermined pitch by the first and second abutting portions of said tray abutting members.

2. A tray transfer device operable with a plurality of bobbin spindles arranged in a first predetermined pitch, said device for transferring a tray carrying a bobbin on a disk-like base member of the tray along a tray feeding path, characterized in that the disk-like base member of the tray has a concave engaging portion formed in a lower face thereof, and said tray transfer device includes a sliding bar which is reciprocally moved along the tray feeding path by a distance substantially equal to a second predetermined pitch, and engaging members which are located on the sliding bar in a pitch substantially equal to the first predetermined pitch and engageable with the concave engaging portion of the tray to move the tray.

3. A tray transfer device as claimed in claim 2, wherein said engaging member comprises a leaf spring which has one end secured to the sliding bar by means of a screw and the other end thereof positionable and engageable with the concave engaging portion of the tray.

4. A tray transfer device as claimed in claim 2, wherein a pitch of the reciprocal movement of the sliding bar is set to be a little greater than the first determined pitch.

5. A tray transfer device as claimed in claim 4, wherein a positioning plate is securely located on a guide plate of the tray feeding path at each of positions adjacent the spindles and has a contacting portion for contacting with the disk-like member of tray and a turning back preventing stopper for preventing turning back of a preceding tray.

6. A tray transfer device as claimed in claim 2, wherein the engaging members operate to move the tray in the first direction along the tray feeding path, said device further comprising a plurality of tray abutting member adjacent the tray feeding path, each tray abutting member having a first abutting surface arranged to abut a tray and hinder movement of a tray in the first direction and a second abutting surface arranged to abut a tray and hinder movement in the direction opposite to the first direction.

7. A tray transfer device as claimed in claim 6, wherein the plurality of tray abutting members are spaced apart by a pitch substantially equal to the first predetermined pitch.

8. A tray transfer device as claimed in claim 6, wherein the plurality of tray abutting members are arranged adjacent one another, with the first abutting surface of one of the tray abutting members being spaced apart from the second abutting surface of an adjacent tray abutting member by a distance substantially equal to the distance across a tray being transferred, wherein the tray abuts the first abutting surface of a tray abutting member and simultaneously abuts the abutting surface of the adjacent tray abutting member.

9. A tray transfer device as claimed in claim 8, wherein the first abutting surface of each tray abutting member is spaced apart from the first abutting surface of each adjacent tray abutting member by a pitch substantially equal to the first predetermined pitch.

10. A tray transfer device as claimed in claim 6, wherein each tray abutting member is arranged at a position adjacent the tray feeding path, said device further comprising adjustment means for adjusting the position at which each tray abutting member is arranged.

11. A tray transfer device for transferring a plurality of bobbin supporting trays along a tray feeding path, each of said trays having a concave portion, said tray transfer device comprising:

a plurality of releasable engaging members arranged adjacent a feeding path, each releasable engaging member adapted to releasably engage the concave portion of a tray;

drive means for moving each releasable engaging member in a first direction along the tray feeding upon the releasable engaging member engaging the concave portion of a tray, wherein upon moving in the first direction, the engaged tray is also moved in the first direction;

a plurality of tray abutting members arranged adjacent the tray feeding path, each tray abutting member having a first abutting surface arranged to abut a tray and hinder movement of a tray in the first direction and a second abutting surface arranged to abut a tray and hinder movement of a tray in the direction opposite the first direction.

12. A tray transfer device as claimed in claim 11, wherein the drive means is further operable for moving each releasable engaging member in a direction opposite to the first direction along the tray feeding path, wherein the releasable engaging members have releasing means for releasing the concave portion of a tray upon being moved in the direction opposite to the first direction.

13. A tray transfer device as claimed in claim 11, wherein the tray transfer device is operable with a plurality of bobbin spindles spaced apart by a predetermined pitch, and wherein the plurality of tray abutting members are spaced apart by a pitch substantially equal to the predetermined pitch.

14. A tray transfer device as claimed in claim 11, wherein the first and second abutting surfaces of the abutting members are arranged to abut first and second positions, respectively, of the tray, and wherein the plurality of tray abutting members are arranged adjacent one another with the first abutting surface of one of the tray abutting members being spaced apart from the second abutting surface of an adjacent tray abutting member by a distance substantially equal to the distance between the first and second positions of a tray being transferred, wherein the tray abuts the first abutting surface of a tray abutting member and simultaneously abuts the second abutting surface of the adjacent tray abutting member.

15. A tray transfer device as claimed in claim 14, wherein the first abutting surface of each tray abutting member is spaced apart from the first abutting surface of each adjacent tray abutting member by a pitch substantially equal to the predetermined pitch.

16. A tray transfer device as claimed in claim 11, wherein each tray abutting member is arranged at a position adjacent the tray feeding path, said device further comprising adjustment means for adjusting the position at which each tray abutting member is arranged.

17. A method of transferring a plurality of bobbin supporting trays along a tray feeding path, wherein each bobbin supporting tray has a concave portion, said method comprising the steps of:

engaging the concave portion of each tray with an engaging member;

moving the engaging member and the engaged tray in a first direction along the tray feeding path;

stopping the movement of the tray engaging member and the tray at a predetermined position in the tray feeding path;

preventing movement of the tray in the first direction with the first tray abutting member arranged to abut the tray at the predetermined position in the tray feeding path;

preventing movement of the tray in the direction opposite to the first direction with a second tray abutting member abutting the tray at the predetermined position in the tray feeding path.

18. A method as claimed in claim 17, further comprising the steps of:

releasing the engaging member from the concave portion of the tray;

moving the engaging member in the direction opposite to the first direction.

19. A method as claimed in claim 17, wherein said steps of releasing and moving the engaging member in the direction opposite to the first direction are performed simultaneously.

* * * * *